US007587851B1

(12) United States Patent
Luth

(10) Patent No.: US 7,587,851 B1
(45) Date of Patent: Sep. 15, 2009

(54) RECEIVER GASKET

(75) Inventor: Randy E. Luth, Becker, MN (US)

(73) Assignee: DPMS Firearms, LLC, Windham, ME (US)

( * ) Notice: Subject to any disclaimer, the term of this patent is extended or adjusted under 35 U.S.C. 154(b) by 0 days.

(21) Appl. No.: 11/532,706

(22) Filed: Sep. 18, 2006

(51) Int. Cl.
*F41A 19/00* (2006.01)
*F41A 17/00* (2006.01)

(52) U.S. Cl. ..... 42/69.01; 42/83; 42/85; 42/96; 124/31; 124/32

(58) Field of Classification Search ..... 42/69.01, 42/71.01–74, 83, 85, 96; 124/31, 32; 413/9; D22/108, 199; D23/269
See application file for complete search history.

(56) References Cited

U.S. PATENT DOCUMENTS

| | | | | |
|---|---|---|---|---|
| 2,364,340 | A | 12/1944 | Bogg, Jr. | |
| 2,932,334 | A | 4/1960 | Steen | |
| 3,924,512 | A * | 12/1975 | Fagg | 89/128 |
| 4,348,829 | A | 9/1982 | Bosco et al. | |
| 4,398,367 | A | 8/1983 | Gamble et al. | |
| D277,774 | S * | 2/1985 | Ruffino | D22/109 |
| 5,038,507 | A | 8/1991 | Dennis, Jr. | |
| 5,105,571 | A * | 4/1992 | Kinchin et al. | 42/96 |
| 5,636,789 | A * | 6/1997 | Shook | 239/124 |
| 5,761,840 | A * | 6/1998 | Martin et al. | 42/17 |
| 6,164,003 | A * | 12/2000 | Miller | 42/71.01 |
| 6,164,004 | A | 12/2000 | Essary | |
| 6,722,072 | B1 * | 4/2004 | McCormick | 42/75.03 |
| 6,760,991 | B1 * | 7/2004 | Gentry | 42/23 |
| 6,922,932 | B2 * | 8/2005 | Hengstenberg et al. | 42/51 |
| 7,051,467 | B1 * | 5/2006 | Huber | 42/69.01 |
| 7,222,891 | B2 * | 5/2007 | Johansson | 292/304 |
| D580,007 | S * | 11/2008 | Luth | D22/108 |
| 2005/0066566 | A1 * | 3/2005 | Hengstenberg et al. | 42/51 |
| 2007/0006510 | A1 * | 1/2007 | McCormick | 42/75.02 |

* cited by examiner

*Primary Examiner*—Bret Hayes
*Assistant Examiner*—Michael D David
(74) *Attorney, Agent, or Firm*—McKee, Voorhees & Sease, P.L.C.

(57) ABSTRACT

A gasket designed to fit into the bottom of the lower receiver of an M16 and AR style rifle. The gasket assists in preventing debris and blown primers from inhibiting the firing motion of the trigger of the rifle. The gasket surrounds a portion of the trigger within the lower receiver without impeding the movement of the trigger. The gasket lies flat in the bottom of the lower receiver and is retained in place by the installed trigger and trigger spring.

13 Claims, 5 Drawing Sheets

RECEIVER GASKET

BACKGROUND OF THE INVENTION

The invention generally pertains to rifles and specifically to the lower receiver of the M16, AR style rifles and other similar rifles.

The M16 and AR style rifles target reliability of the mechanical parts as a polestar in the development of both rifles. The lower receiver of both of these styles of rifles accommodates the trigger and firing control parts. Any restriction of the free movement of these parts may cause the rifle to malfunction. Current M16 and AR style rifles have nothing to prevent blown primers and debris from falling into or lodging about and under the trigger and other firing control parts.

Some innovations have taken to providing protection for the working mechanisms of various firearms from external elements, such as moisture, dust and/or dirt. In particular, U.S. Pat. No. 5,038,507 issued to Dennis, Jr. discloses a guard cover that bolts over the remote trigger mechanism to prevent intrusion of dust and other debris from the ambient environment. U.S. Pat. No. 4,348,829 to Bosco et al. discloses a removable weather shield designed to closely conform to and contact the exterior surface of the rifle to provide an adequate sealing of the firing mechanism from the external environment. U.S. Pat. No. 2,364,340 to Bogg, Jr. teaches a shield for a gun firing mechanism. The shield protects the bolt mechanism from moisture, dust and dirt and may be readily removed to permit use of the weapon. U.S. Pat. No. 6,164,004 to Essary discloses a protective cover for the firing mechanism of a muzzle loading rifle. The protective cover is a tubular sleeve that covers the external firing mechanism. U.S. Pat. No. 4,398,367 to Gamble et al. discloses a protector for muzzle loading rifles, which may be removed from the hammer and flash pan assembly for use of the rifle yet remain attached to the rifle so as not to be lost. U.S. Pat. No. 2,932,334 to Steen teaches a cover member designed to protect only the breech and trigger mechanisms of rifles, shotguns and the like. The mechanism completely covers the firing mechanism including the trigger of the gun thereby excluding rain, dust and undesirable elements from the covered parts. Although considerations have been given for protecting the trigger and firing mechanisms from external elements, nothing has been innovated for protecting the trigger and firing control parts of the M16 and AR style rifles from blown primers and debris.

Therefore, there is a need to produce a fitted receiver gasket for the M16 and AR style rifles to prevent and/or block debris and blown primers from falling into and restricting movement of the trigger and/or firing control parts.

Additionally, the fitted receiver gasket for the M16 and AR style rifle fits into the bottom of the lower receiver and remains in position by installation of the trigger and trigger spring.

Lastly, the installed fitted receiver gasket allows free movement of the trigger and firing control parts while preventing other debris from falling into or under the trigger and fire control parts.

These and other objectives will become apparent from the following specification and drawings.

BRIEF SUMMARY OF THE INVENTION

The foregoing objectives may be achieved by a gasket or molded/fitted object fitting the lower receiver of an M16, an AR style rifle or a similar rifle for preventing debris and blown primers from inhibiting the firing motion of the trigger. The improvement includes a rifle having a barrel, a trigger, an upper receiver, a lower receiver, and a stock. The gasket is shaped to fit about the trigger within the lower receiver of the rifle such that the gasket assists in preventing debris and blown primers from inhibiting the firing motion of the trigger.

According to another feature of the present invention, the gasket is constructed of rubber.

According to another feature of the present invention, the rifle is an M16 or an AR style rifle.

According to another feature of the present invention, the gasket is designed having a first and a second leg and a space between the first and the second leg. The space permits the trigger to pass through an aperture in a bottom of the lower receiver. A bottom portion of the trigger rests within the space of the gasket such that the gasket assists in preventing debris and blown primers from inhibiting the firing motion of the trigger.

According to another feature of the present invention, the gasket is retained in place by installation of the trigger and trigger spring.

According to another feature of the present invention, the gasket lies flat on the bottom of the lower receiver.

DETAILED DESCRIPTION OF THE PREFERRED EMBODIMENT

Figure 1:
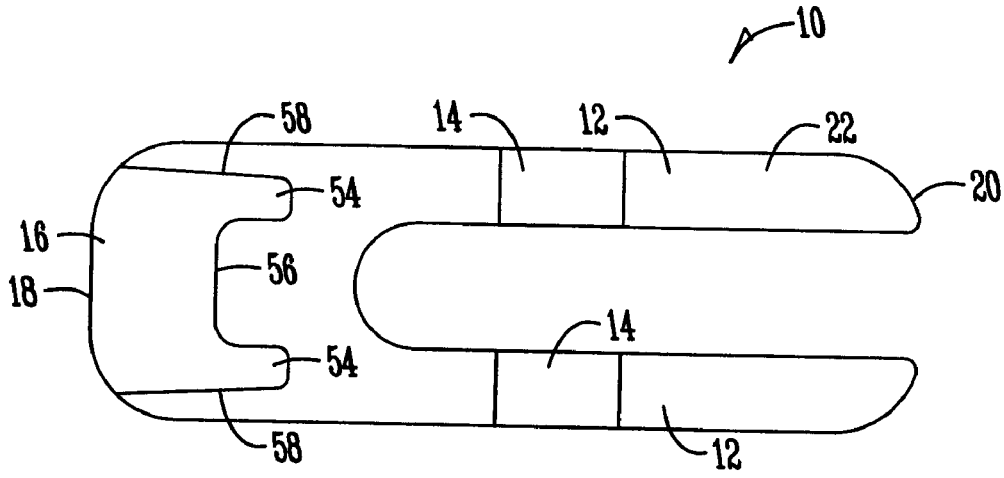
FIG. 1 is a top view of the receiver gasket.
Figure 2:
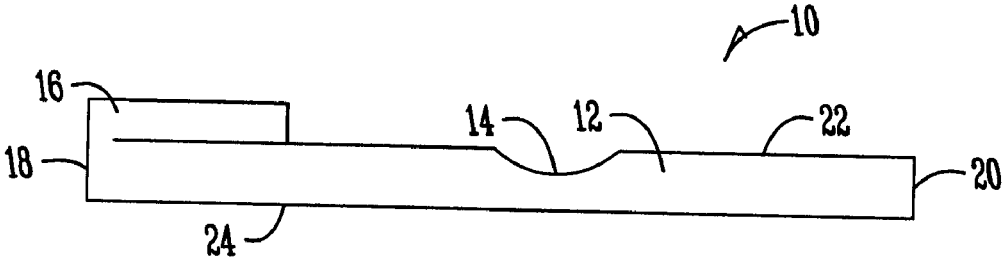
FIG. 2 is a side view of the receiver gasket.
Figure 3:
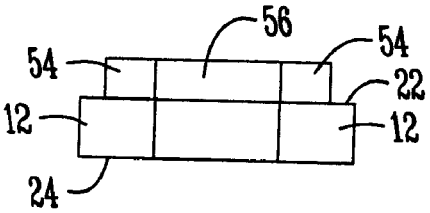
FIG. 3 is a rear view of the receiver gasket.
Figure 4:
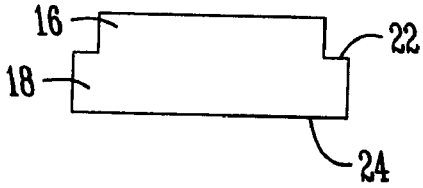
FIG. 4 is a front view of the receiver gasket.

With reference to FIGS. 1-4, numeral 10 refers to a receiver gasket. The receiver gasket 10 is designed to fit within the bottom of the lower receiver of an M16 and AR style rifle to prevent and/or block blown primers and debris from falling into or under the trigger and fire control parts.

The receiver gasket 10 is designed for use with an M16, an AR style rifle or other similar rifles. The receiver gasket 10 is preferably constructed of a pliable rubber material, one capable of retaining its shape over time, withstanding exposure to and interrogation by blown primers and other debris and sufficiently resilient to changes in the ambient environment. The receiver gasket 10 has front 18, back 20, top 22 and bottom 24 sides. The front side 18 has a raised portion 16 that is thicker than the planar legs 12. The raised portion 16 is coplanar with the front 18 of the receiver gasket 10. A cavity 56 is formed in the rearward portion of the raised portion 16. The cavity 56 has the same thickness as the legs 12 of the receiver gasket 10. The cavity 56 is bounded in part by two prongs 54 having the same thickness as the raised portion 16. The two prongs 54 also form a part of the outer boundary 58 of the raised portion 16. The raised portion 16 extends rearward from the front 18 of the receiver gasket 10. The legs 12 begin near the raised portion 16 extending to the back 20 of the receiver gasket 10. The legs 12 each have a concave trigger spring recess 14 to accommodate the trigger 34. A gap separates one leg 12 from the other leg 12 to accommodate a portion of the trigger 34 passing through the bottom of the lower receiver to the exterior of the lower receiver. The gap also accommodates passage of the bolt used to secure the pistol grip to the lower receiver.

Figure 5:
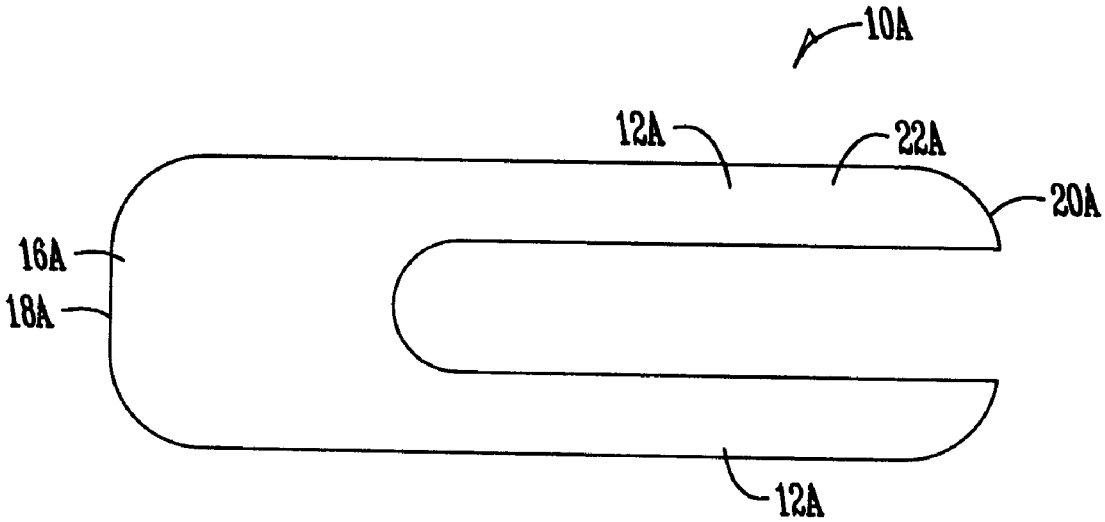
FIG. 5 is a top view of another embodiment of the receiver gasket designed for an adjustable trigger.
Figure 6:
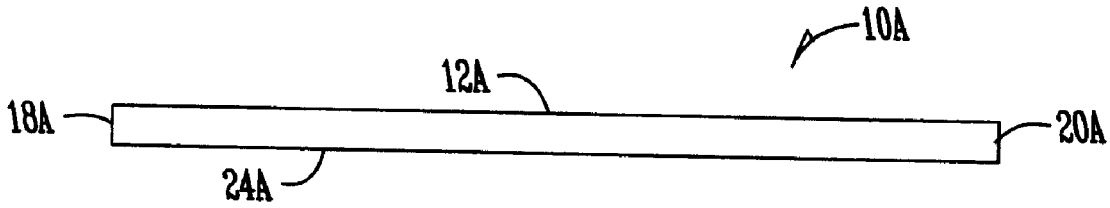
FIG. 6 is side view of another embodiment of the receiver gasket.

FIG. 5 is a top view of another embodiment of the receiver gasket. The receiver gasket 10A, shown in FIGS. 5 and 6, is similar in size and shape to the receiver gasket shown in FIGS. 1-4. The gasket 10A is also constructed of a similar material. Different from the receiver gasket show in FIGS. 1-4, the gasket 10A is planar from the front 18A to the back 20A, as best illustrated in FIG. 5. Unlike the receiver gasket show in FIGS. 1-4, the gasket 10A does not have a raised portion near the front 18A of the gasket 10A. The receiver gasket 10A prevents blown primers and debris from lodging about and beneath the trigger.

Figure 7:
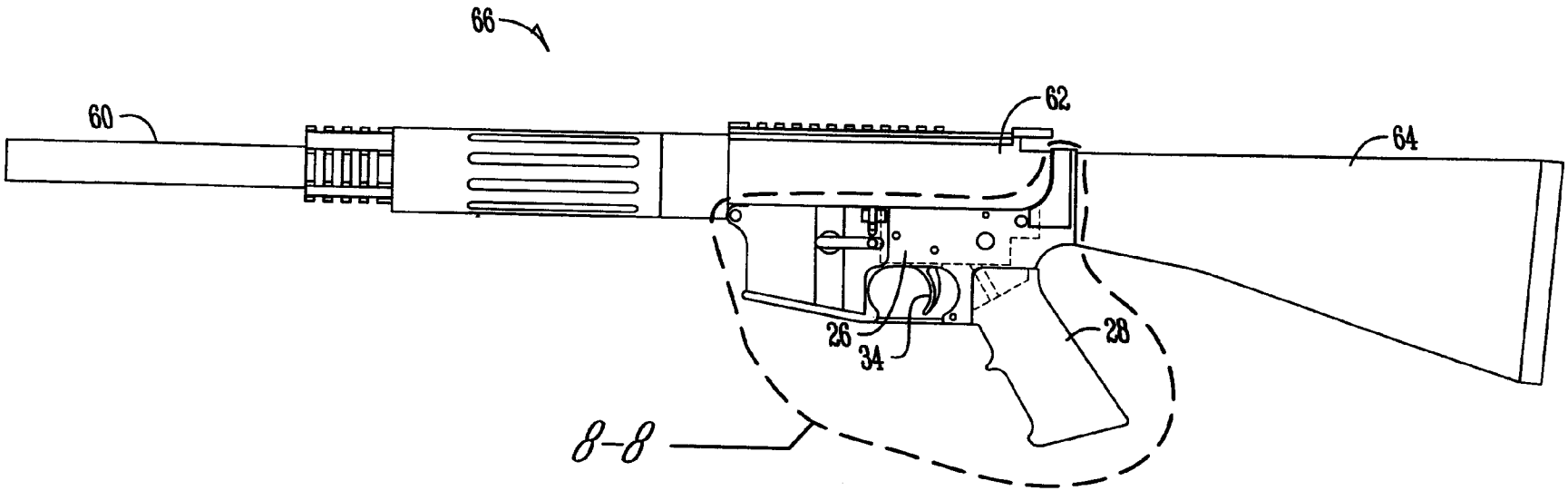
FIG. 7 is a side view of a rifle.

FIG. 7 is a side view of a rifle. The rifle 66 represents any M16, an AR styled rifle or similar rifle. The rifle 66, as shown, consists of a barrel 60, an upper receiver 62, a lower receiver 26, a trigger 34, a pistol grip 28 and a stock 64.

Figure 8:
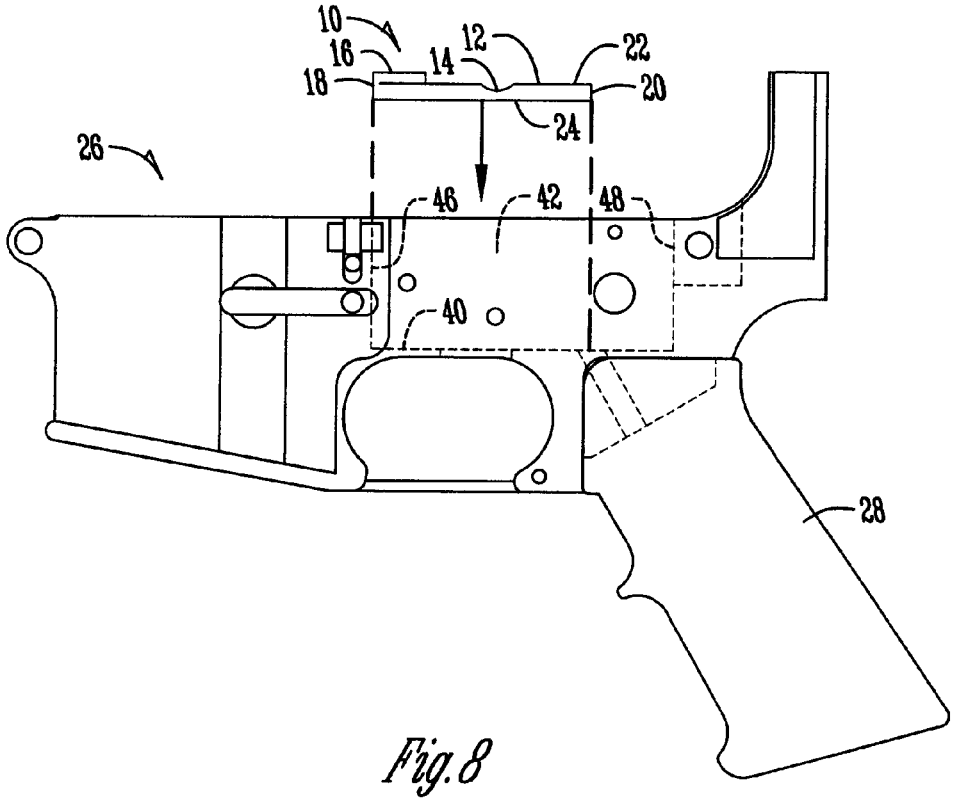
FIG. 8, is a side view of the receiver gasket and the lower receiver in FIG. 7 taken along line 8-8.

FIG. 8, is a side view of the receiver gasket and the lower receiver in FIG. 7 taken along line 8-8. The lower receiver 26 can be the lower receiver of an M16, an AR15 style rifle or similar rifle. A pistol grip 28 is attached to the lower receiver 26. The receiver gasket 10 is positioned above the lower receiver 26, showing the position and angle at which the receiver gasket 10 is lowered into and positioned at the bottom 40 of the cavity 42 formed in the lower receiver 26.

Figure 9:
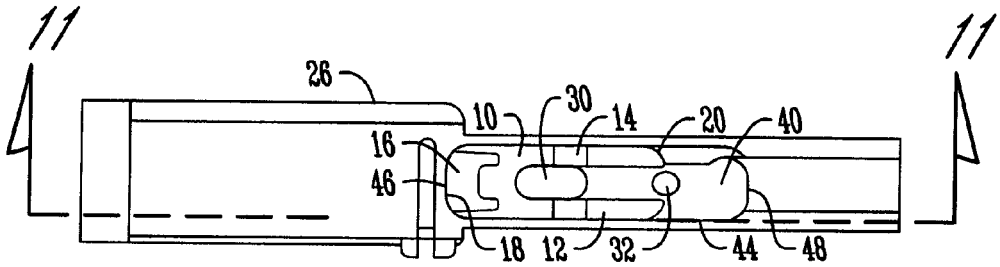
FIG. 9, is a top view of the receiver gasket placed in the bottom of the full-automatic lower receiver in FIG. 7 taken along line 8-8.

FIG. 9, is a top view of the receiver gasket placed in the bottom of the full-automatic lower receiver in FIG. 7 taken along line 8-8. In FIG. 9 the receiver gasket 10 is shown positioned in the bottom 40 of the lower receiver 26. The front 18 of the receiver gasket 10, having the raised portion 16, is positioned near the front 46 of the cavity 42 within the lower receiver 26. The legs 12 of the lower receiver extend from the raised portion 16 toward the back 48 of the cavity 42 within the lower receiver 26. The inner portion of the legs 12 form a boundary about the trigger aperture 30 formed in the bottom 40 of the lower receiver 26 to the exterior of the lower receiver 26. Trigger aperture 30 accommodates passage of the trigger 34 from within the lower receiver 26 through the bottom 40 of the lower receiver 26. The outer boundary of the receiver gasket 26 abuts the inner walls 44 near the bottom 40 of the lower receiver 26. Near the back 20 of the lower receiver 10, one side of the lower receiver 26 inner wall 44 is tapered, while the opposing inner wall 44 is coplanar with the cavity 42 wall resting flush against the outer edge of the leg 12 of the receiver gasket 10. The area, just rearward of the back 20 of the receiver gasket 10, is to accommodate the mechanical parts for making the M16 and AR style rifle a fully automatic rifle.

Figure 10:
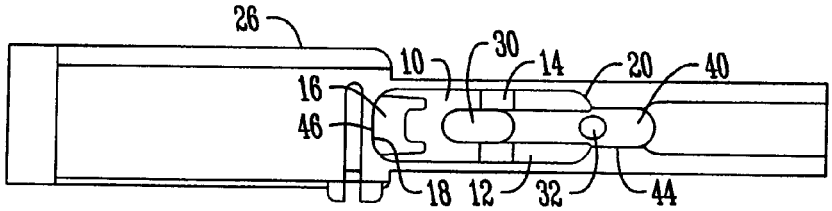
FIG. 10 is a top view of the receiver gasket placed in the bottom of the semi-automatic lower receiver in FIG. 7 taken along line 8-8.

FIG. 10 is a top view of the receiver gasket placed in the bottom of the semi-automatic lower receiver in FIG. 7 taken along line 8-8. FIG. 10 is similar to FIG. 9 except that both inner walls 44 near the back 20 of the receiver gasket 10 are tapered inward toward each other.

Figure 11:
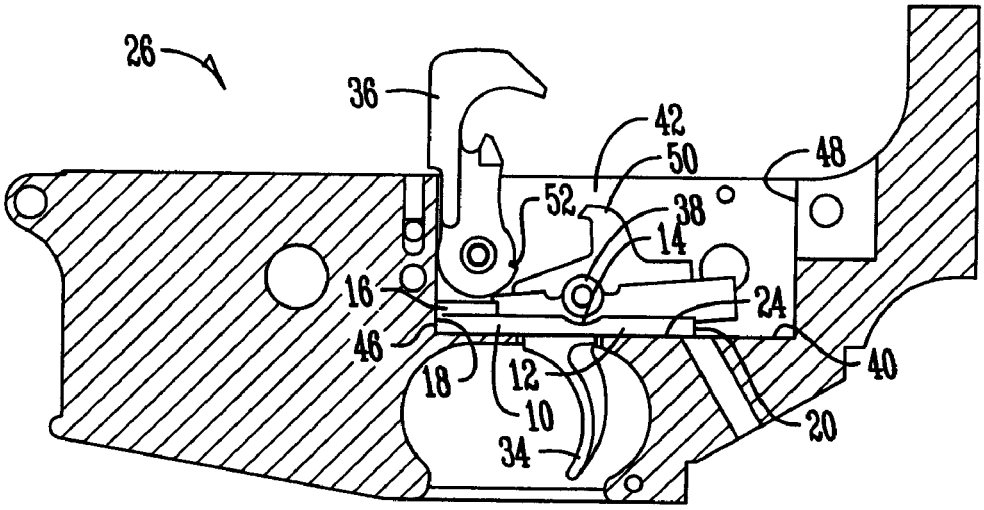
FIG. 11, showing the hammer in the released position, is a side view of the receiver gasket and lower receiver in FIG. 9 taken along line 11-11.
Figure 12:
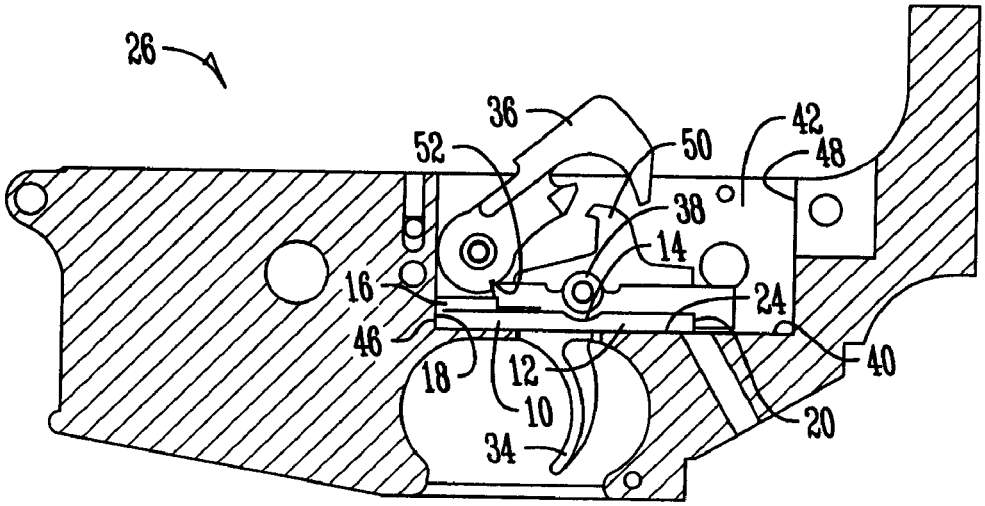
FIG. 12, showing the hammer in the cocked position, is a side view of the receiver gasket and lower receiver in FIG. 9 taken along line 11-11.

FIG. 11, showing the hammer in the released position, is a side view of the receiver gasket and lower receiver in FIG. 9 taken along line 11-11. In FIGS. 11 and 12, the receiver gasket 10 is positioned at the bottom 40 of the lower receiver 26. The front end 18 abutting the front 46 of the lower receiver cavity 42 and the legs 12 extend rearward toward the back 48 of the lower receiver cavity 42. The bottom 24 of the receiver gasket 10 rests flush on the lower receiver bottom 40. In FIG. 11 the hammer 36 is shown in the released position. The trigger 34 is positioned in the lower receiver bottom 40. The trigger 34 extends through the trigger aperture 30. The trigger 34 is a single part; the upper half of the trigger 34 resides in the lower receiver cavity 42 and the lower half extends through the trigger aperture 30 presenting a lever outside the lower receiver 26 for the user to move thereby firing the rifle. The cavity 56 formed by the two legs 54 of the raised portion 16 (best illustrated by FIG. 1) provides a protective recess for the trigger 34, to prevent debris and blown primers from impeding the firing motion of the trigger 34. The two legs 54 and cavity 56 surround the forward bottom portion of the trigger 34 within the lower receiver cavity 42 and prevent blown primers and debris from obstructing the trigger's movement. A disconnector 50 attaches to the trigger 34. The receiver gasket 10 is held in place by the installed trigger 34 and corresponding trigger spring 38. The hammer 36 is positioned atop of the raised portion 16 at the front 18 of the receiver gasket 10. The raised portion 16 prevents blown primers or debris form lodging beneath the trigger 34. The legs 12 of the receiver gasket 10 straddle and abut closely the lower outer side edges of trigger 34 without obstructing movement of the trigger 34. The near proximity of the legs 12 to the outer boundary of the trigger 34 within the lower receiver bottom 42 prevents blown primers and debris from lodging beneath the trigger 34. The pivot or point of rotation of the trigger 34 and coil of the trigger spring 38 rest atop the trigger spring recess 14 in the receiver gasket 10. Both the trigger 34 and corresponding trigger springs 38 help secure the receiver gasket 10 against movement within the lower receiver bottom 40.

FIG. 12, showing the hammer in the cocked position, is a side view of the receiver gasket and lower receiver in FIG. 9 taken along line 11-11. FIG. 12 illustrates the free unfettered movement of the hammer 36 from the released position to the cocked position. In particular, the trigger 34 catches the latch 52 positioned on the hammer 36 as the hammer 36 moves from the released (fired) position to the cocked (unfired) position. The receiver gasket 10 allows the trigger 34 to rotate counterclockwise for firing the rifle by releasing the hammer 36. The near proximity of the legs 12 and the bottom portion of the trigger 34 assists in preventing blown primers and debris from lodging beneath the trigger 34.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A system, comprising:

a rifle having a barrel, a trigger, an upper receiver, a lower receiver and a stock; and a gasket, the gasket shaped to fit within a bottom of the lower receiver of the rifle, the gasket having a first leg and a second leg extending from and having terminating end portions separated by an open-ended space;

the trigger mounted within the bottom of the lower receiver of the rifle, the trigger fitting within the space and a pocket such that the gasket assists in preventing debris and blown primers from lodging beneath the trigger and the bottom of the lower receiver.

2. The improvement of claim 1 wherein the gasket is constructed of rubber.

3. The improvement of claim 1 wherein the rifle is an M16, an AR style rifle or other similar rifle.

4. The improvement of claim 1 wherein the open-ended space permits a portion of the trigger to pass through an aperture in the bottom of the lower receiver.

5. The improvement of claim 1 wherein the gasket is retained on the bottom of the lower receiver by the trigger and trigger spring.

6. The improvement of claim 1 wherein the gasket lies flat on and is held in place solely by the bottom of the lower receiver and the trigger.

7. An apparatus for assisting in the operation of a rifle, comprising:

a gasket body, the gasket body comprising open-ended first and second legs terminating in separated end portions separated by a space; and the gasket body comprising a front portion opposite the separated end portions connecting the open-ended legs together and forming a pocket adapted for fitting underneath a trigger of the rifle to assist in preventing debris and blown primers from inhibiting the firing motion of the trigger.

8. The gasket body of claim 7 wherein the separated end portions of first and second legs fit about the trigger within the lower receiver of an M16, an AR style rifle or similar rifle.

9. The gasket body of claim 7 wherein the open-ended first and second legs are coplanar with the front portion.

10. The gasket body of claim 7 wherein the front portion further comprises a raised portion, the raised portion having first and second parallel prongs, the pocket formed between the first and second parallel prongs.

11. The gasket body of claim 10 wherein the pocket is coplanar with the open-ended first and second legs.

12. The gasket body of claim 11 wherein the pocket is adapted to occupy space around bottom edges of the trigger.

13. The gasket body of claim 12 wherein a recess is formed in the open-ended first and second legs, the recess adapted to receive the trigger and trigger spring.

* * * * *